United States Patent [19]

Eibe

[11] 4,445,349

[45] May 1, 1984

[54] VARIABLE CROWN ROLL SHAPE CONTROL SYSTEMS

[75] Inventor: Werner W. Eibe, McCandless Township, Allegheny County, Pa.

[73] Assignee: White Consolidated Industries, Inc., Cleveland, Ohio

[21] Appl. No.: 322,196

[22] Filed: Nov. 17, 1981

[51] Int. Cl.[3] ..... B21B 37/08

[52] U.S. Cl. ..... 72/17; 29/113 AD; 72/243; 73/862.07; 100/162 B

[58] Field of Search ..... 29/113 R, 113 AD; 72/243, 205, 17; 73/862.07, 862.55, 159; 100/162 B

[56] References Cited

U.S. PATENT DOCUMENTS

| | | | |
|---|---|---|---|
| 1,277,995 | 9/1918 | Muskett | 29/113 R |
| 3,043,211 | 7/1962 | Appenzeller | 100/162 B |
| 3,098,284 | 7/1963 | Hornbostel | 29/113 AD |
| 3,324,695 | 6/1967 | Sivilotti | 72/205 |
| 3,481,194 | 12/1969 | Sivilotti et al. | 73/862.07 |
| 4,054,043 | 10/1977 | Eibe | 72/8 |
| 4,062,096 | 12/1977 | Eibe | 29/113 |
| 4,118,963 | 10/1978 | Eibe | 72/21 |
| 4,356,714 | 11/1982 | Quehen | 72/17 |

*Primary Examiner*—Lowell A. Larson
*Assistant Examiner*—Steven B. Katz
*Attorney, Agent, or Firm*—Buell, Blenko, Ziesenheim & Beck

[57] ABSTRACT

A hydraulically inflatable roll for flat rolled products is formed with a constant cross section internal fluid channel spaced uniformly from its working surface and extending spirally from end to end of the roll. The channel is connected through an end of the roll to a source of hydraulic fluid under pressure and also to a pressure transducer which in turn is connected to a display device. A proximity trigger is associated with an end of the roll so as to signal the start and the end of the circumferential travel of the channel past the contact line between roll and work when the roll is rotated, and the pressure exerted on that moving area in that interval is continuously measured and transmitted to the display device. Means are also disclosed for using that signal to control gauge and shape of the rolled product.

9 Claims, 7 Drawing Figures

VARIABLE CROWN ROLL SHAPE CONTROL SYSTEMS

This invention relates to apparatus for measuring and controlling the crown of rolls for rolling flat rolled products and for measuring and controlling the shape of the product. It is more particularly concerned with such apparatus for continuous measurement and control utilizing a hydraulically inflatable crowned roll.

In order to produce flat rolled products of uniform gauge or thickness it is necessary to adjust the crown of the working rolls so as to maintain uniform width of the roll gap. Desirably this adjustment should be continuous in accordance with continuously measured width of roll gap along the rolls. In order to provide strip of desirable shape or profile--that is to say, product free from center buckles and edge waves or flutes--it is likewise necessary to adjust the roll crown. Desirably this adjustment should also be continuous but in accordance with continuous measurement across the strip of the shape of the strip leaving the mill.

Prior to my invention to be described hereinafter there has been no satisfactory apparatus devised for continuously measuring the width of roll gap during rolling from one end of the roll to the other, nor satisfactory apparatus for continuously measuring the shape of rolled strip leaving a mill from one edge of the strip to the other. My U.S. Pat. No. 4,131,004 discloses apparatus for calibrating the roll gap of a mill by directly measuring the pressure between the rolls at various points along those rolls, but it cannot be used during the rolling operation. Prior art crown and shape control apparatus has had to rely on indirect devices for continuously measuring gauge and flatness which, at best, sample the product at different areas across its width. My U.S. Pat. Nos. 4,054,043 and 4,118,963 disclose a closed loop integrated gauge and crown control system which reduces or eliminates interfering effects of gauge and crown adjustment.

An important element of my system above-mentioned is my hydraulically inflatable crown roll disclosed in my U.S. Pat. No. 4,062,096. A modification of that roll is the basis of my invention to be described hereinafter. The modified roll is formed with a constant cross section internal fluid channel spaced uniformly from its working surface and extending spirally from end to end of the roll. The roll may be formed with more than one such channel. The channel or channels are connected through an end of the roll to a source of hydraulic fluid under pressure provided with a valve, and a pressure transducer positioned at one end of the roll is also connected to the channel with its output going to a read-out device. Proximity trigger means are positioned at an end of the roll connected with the valve in the hydraulic fluid supply so as to close it from the time one end of the channel in the roll reaches the pass line of the mill until the other end of the channel reaches that pass line. Thus, an area of the roll surface above the channel moves along the roll contact line from end to end as the roll turns, and the pressure exerted in that moving area is continuously measured and transmitted to the read-out device. The signal to the read-out device can, of course, be used for control of gauge and shape in the way shown in my U.S. Pat. Nos. 4,054,043 and 4,118,963 above mentioned.

Embodiments of my invention presently preferred by me are illustrated in the attached figures in which.

Figure 1:
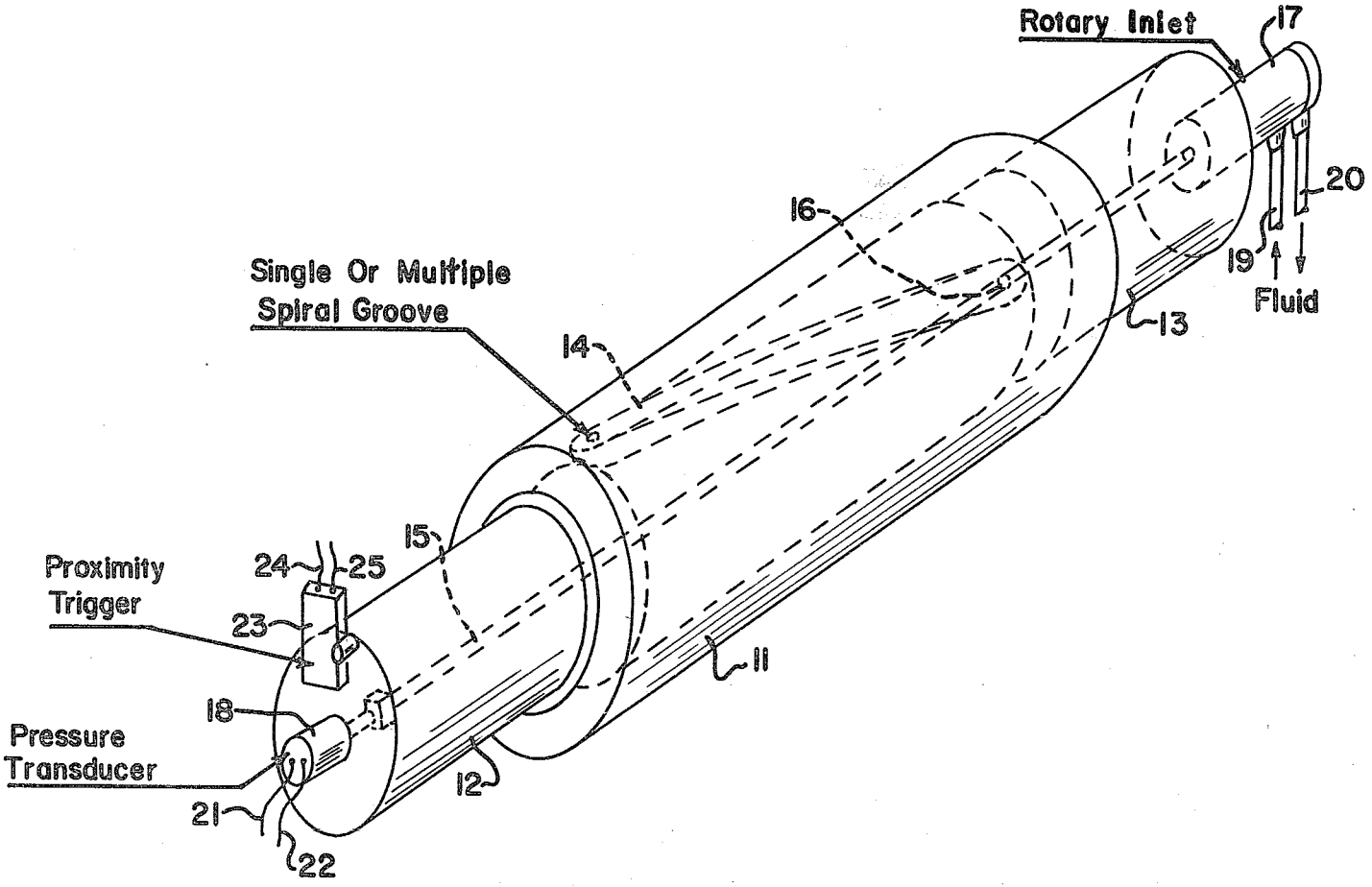
FIG. 1 is an isometric of a rolling mill roll of my invention with its associated hydraulic fluid supply connections, pressure transducer and proximity trigger.
Figure 5:
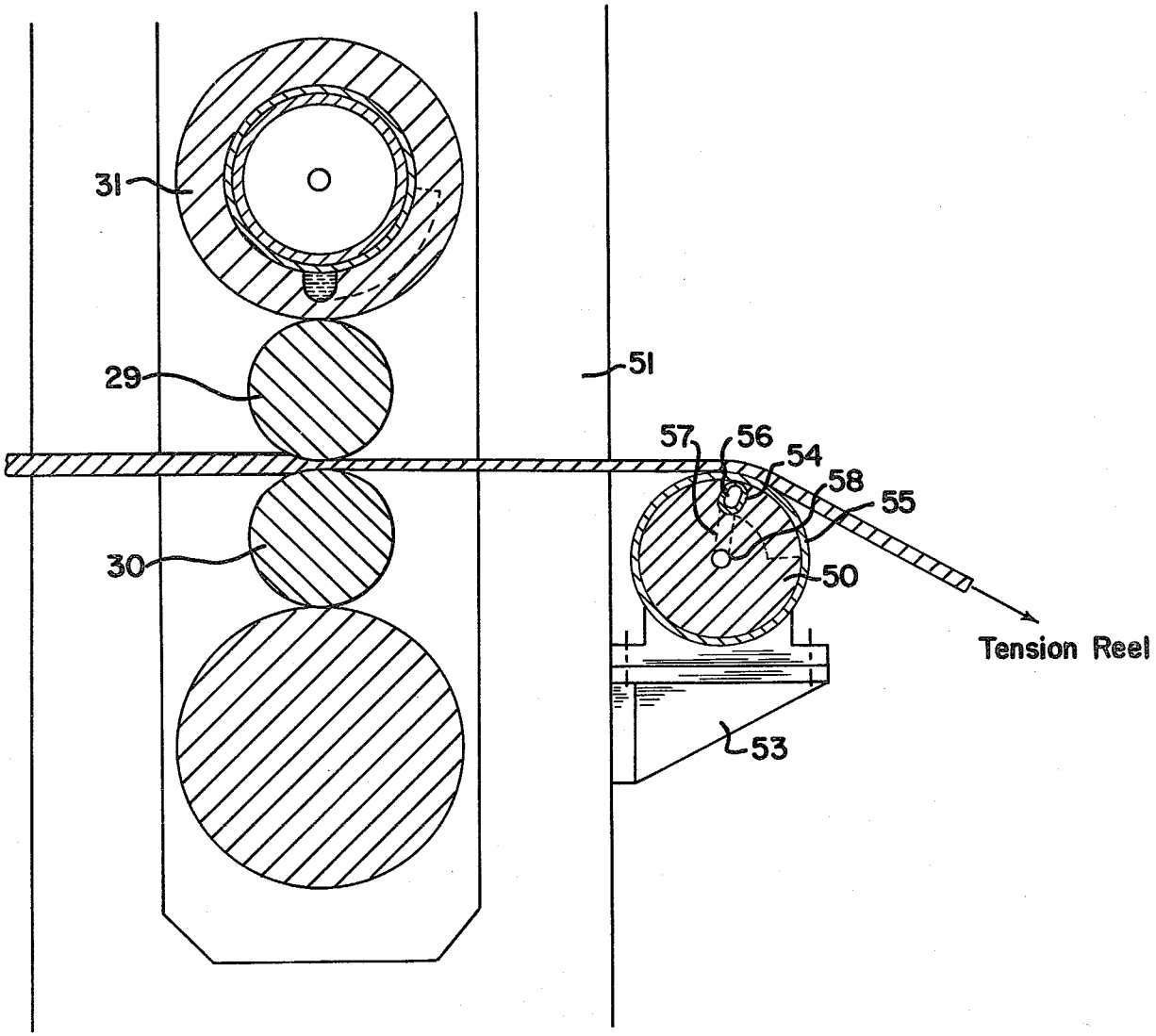
FIG. 5 is an end elevation in section of a portion of a four-high mill stand having a backup roll of my invention and a shape-measuring roll of my invention positioned at the exit end of the stand.

In FIG. 1, the roll has a cylindrical body portion 11 with smaller diameter roll necks 12 and 13. In body portion 11 is formed a closed channel 14 of uniform cross section uniformly spaced below the outer surface of body portion 11 and extending spirally from roll neck 12 to neck 13. I prefer to have the circumferential extent of channel 14 about 90° or so as is shown in FIG. 5, but it is not critical. More than one such channel may be formed in the roll as in shown in FIG. 2. The roll is also formed with a central bore 15 extending through roll body portion 11 and both roll necks 12 and 13. Bore 15 connects with one end of channel 14 at 16, with a rotary inlet 17 of known construction at roll neck 13 and with a pressure transducer 18 of known construction at roll neck 12. Rotary inlet 17 is connected to a hydraulic fluid supply source through conduits 19 and 20. Pressure intensifier means as shown in U.S. Pat. No. 4,062,096 are preferably located in roll neck 13. Leads 21 and 22 from pressure transducer 18 are connected to display or read-out apparatus 45 and valve means 44 in the fluid supply source, both of which are shown schematically in FIG. 2. Proximity trigger means 23 of known construction are positioned adjoining roll neck 12, leads 24 and 25 from which are connected to the read-out apparatus and valve in the fluid supply above mentioned.

The proximity trigger means 23 are positioned to signal the start and the end of the circumferential travel of the channel 14 past the contact line between the roll and the surface against which the roll works, which signals close valve 44 during that interval, so trapping the hydraulic fluid in the channel, and enable the display unit 45 during that interval. Thus as the roll revolves, a constant area of roll surface above the channel moves along the roll contact line from end to end during that interval and the pressure exerted on that moving area is read out on the display unit, preferably as a curve plotted against a parameter related to the width of the surface against which the roll works.

Figure 2:
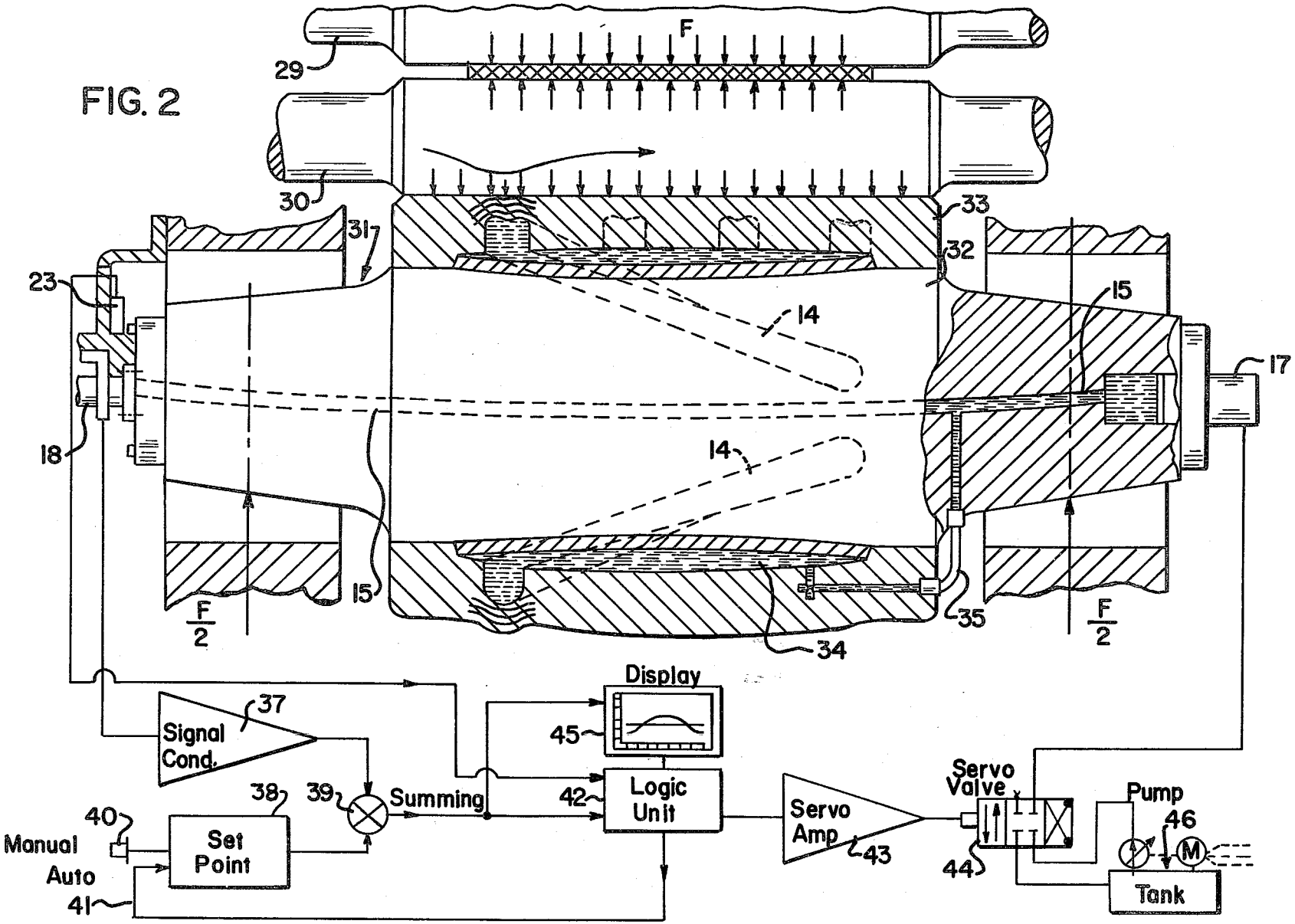
FIG. 2 is an elevation partly in section of a portion of a four-high mill stand utilizing a back-up roll similar to that of FIG. 1 together with a schematic of the circuitry associated therewith.

The roll of FIG. 1 is adapted for use as a continuously adjustable crown roll in a mill stand or as a roll for continuously measuring the shape of rolled strip from edge-to-edge after the strip leaves the mill stand. FIG. 2 illustrates an embodiment of my roll suitable for the first use above-mentioned together with its associated circuits.

In FIG. 2 rolls 29 and 30 are work rolls of a four-high mill stand and roll 31 is a backup roll of my invention.

Roll 31 comprises an arbor 32 surrounded by a sleeve 33, which arbor and sleeve fit tightly together at each end but leave a cavity 34 between them intermediate their ends. This roll construction is that of my U.S. Pat. No. 4,062,096. As in FIG. 1, roll 31 has a central bore 15 extending from end to end connected at one end to pressure transducer 18. At that end is also positioned proximity trigger 23. Cavity 34 is formed with two channels 14 projecting outwardly therefrom and extending spirally of roll 31 from end to end of the working portion thereof. The circumferential extent of each channel 14 is, as before, about 90°. Cavity 34 is connected to bore 13 by conduit 35.

The output of pressure transducer 18 is connected to signal conditioner 37 which in turn is connected to summing junction 39. Also connected to summing junction 39 is set point apparatus 38 having a manual control 40 and an automatic control 41. Summing junction 39 is connected to logic unit 42 and provides a signal thereto, as well as to display apparatus 45, and to servo amplifier 43. Proximity trigger 23 is also connected to logic unit 42 and through it to servo amplifier 43; and provides a signal thereto. Servo amplifier 43 drives servo valve 44 which controls the supply of hydraulic fluid from hydraulic fluid supply means 46 through a rotary inlet, such as inlet 17, and pressure intensifier, not shown, to bore 15 in roll 21.

Figure 3:
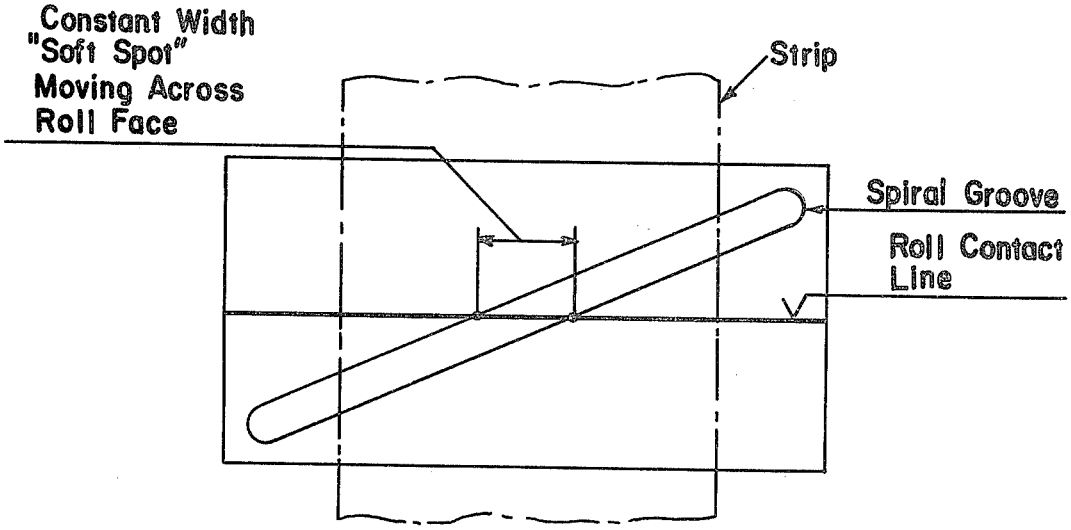
FIG. 3 is a plan of the working surface portion of a roll of my invention showing the pressure-measuring area of the roll channel which moves across the strip during the rotation of the roll.
Figure 4:
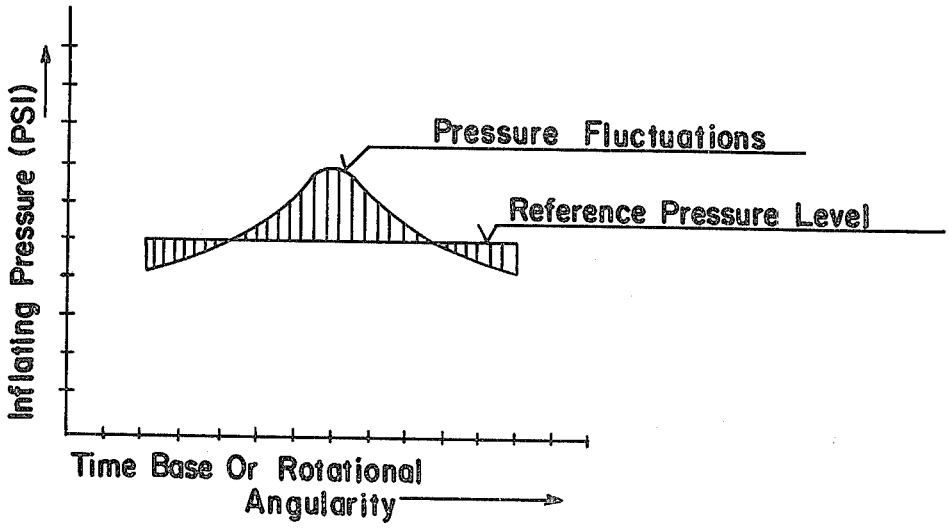
FIG. 4 is a representation of the read-out graph.

In the operation of my apparatus of FIG. 2, hydraulic fluid is supplied from source 46 through rotary valve means 17 to cavity 34, thus expanding sleeve 33 with respect to arbor 32 to form a crown on the roll. The pressure in channels 14 is converted into an electrical signal by pressure transducer 18 and the signal passes through the signal conditioner 37 and summing junction 39 to logic unit 42 and to display read-out 45. Proximity trigger 23 also supplies signals to logic unit 42, enabling it only in the interval when the channels 14 are in pressure transmitting relation to work rolls 29 and 30. Logic unit 42 transmits the signal from proximity trigger 23 to servo amplifier 43, which closes valve 44 in the hydraulic fluid supply line when channels 14 are in that pressure transmitting relation, so as to trap the hydraulic fluid in cavity 34. The pressure of that trapped fluid, which varies as the constant width areas of contact of channels 14 move along the roll contact line, as shown in FIG. 3, is displayed graphically on display unit 45, as in FIG. 4. Set point mechanism 38, which may be manually controlled or automatically controlled from logic unit 42, adjusts the reference pressure level.

The read out display unit 45 corresponds to the variation in the gap between work rolls 29 and 30. As the measurement of pressure in channels 14 occurs only during the portions of a revolution of roll 31 during which servo valve 44 is closed, the pressure readings are stored in a memory in logic unit 42 and are used to control the extent of the interval in which servo valve 44 is opened and connects the roll cavity 34 with the hydraulic fluid supply 46. Logic unit 42 selects that interval in accordance with the pressure reading during the closed interval so as to readjust the crown of roll 31, if necessary, to decrease variation in the width of gap between work rolls 29 and 30 along their length.

Figure 6:
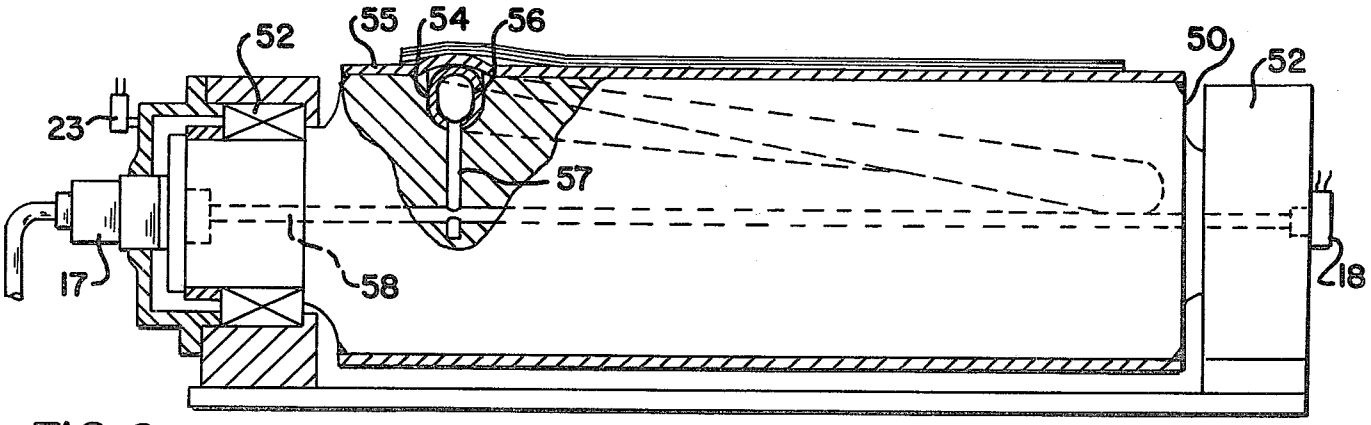
FIG. 6 is an elevation in section of the shape-measuring roll of FIG. 5.
Figure 7:
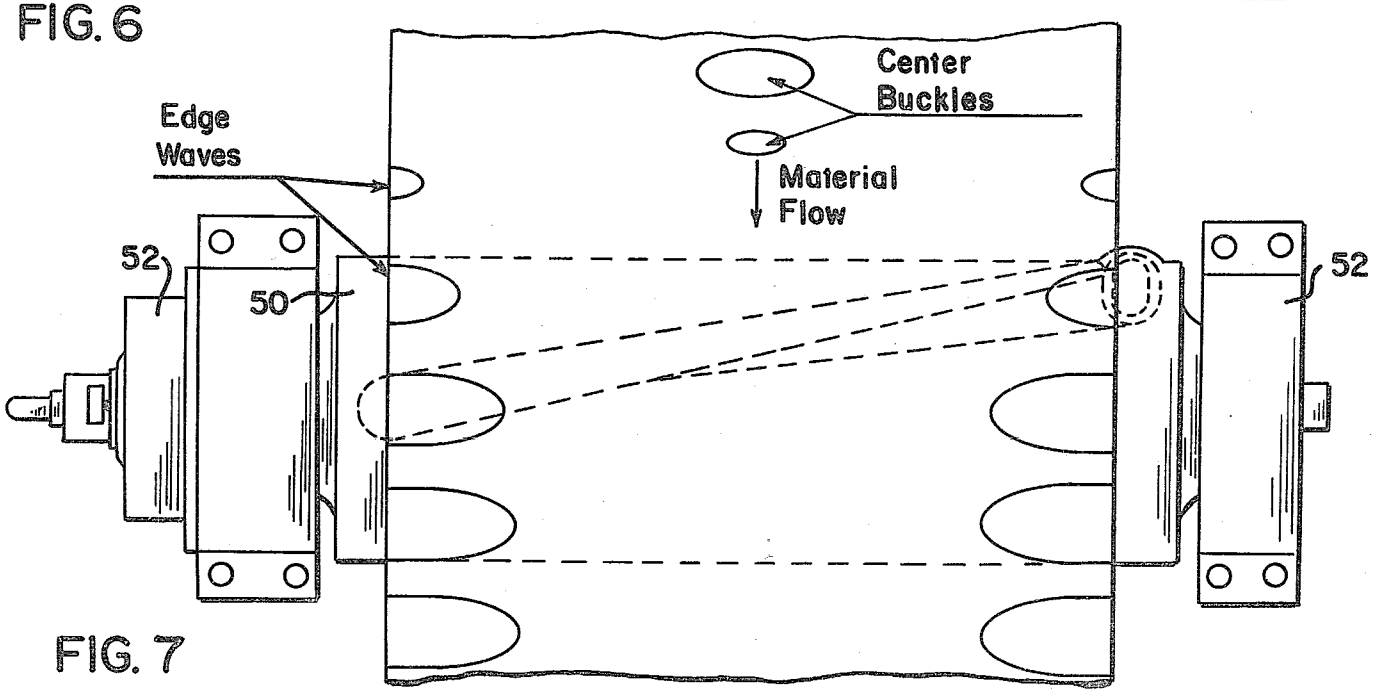
FIG. 7 is a plan of the roll of FIG. 6 and a portion of the strip passing thereover.

FIGS. 6 and 7 illustrate a preferred embodiment of the roll of FIG. 1 adapted for measuring the shape of rolled strip and FIG. 5 shows a roll positioned at the delivery side of a mill stand. Roll 50 is freely rotatable in bearings 52 supported by brackets 53 attached to the mill stand housing 51. The pass line of the mill is tangent to the surface of roll 50 and the strip passes from the mill over roll 50 and is maintained in tension by a tension reel or similar device, not shown. A channel 54 of uniform cross section is formed in roll 50 immediately below a thin surface shell 55 and extends spirally from one end of roll 50 to the other. As before mentioned, the circumferential extent of channel 54 may be 90° or so. Channel 54 is filled by a tube 56 sealed at each end which is connected by conduit 57 to a bore 58 extending the length of roll 50 along its axis. As in FIG. 1 bore 58 is connected to a pressure transducer 18 at one end of roll 50 and through a rotary inlet 17 at the other end to a source of hydraulic fluid under pressure provided with a valve. A proximity trigger 23 is positioned at an end of roll 50. The external circuitry is the same as that of FIG. 2 described hereinabove.

In the operation of the apparatus of FIG. 5, as the strip moves over the roll 50, thus rotating it, the area of tube 56 closest to the strip at the roll contact line, which may be called the "soft spot", moves along the roll contact line from one end of the roll body to the other but maintains a constant dimension along that line. This action is shown in FIG. 3. The dimension of the soft spot normal to the roll contact line is small but is also constant. If the soft spot passes under an upward buckle or bulge in the strip the roll surface immediately above tube 56 is pushed outwardly by the pressure of the hydraulic fluid confined in the tube, and that pressure therefore falls. Conversely if the soft spot passes under a downward bulge in the strip the roll surface immediately below it is pushed in thereby and the pressure of the hydraulic fluid in the channel rises correspondingly. The graph of the read-out connected to the pressure transducer for strip having a downard bulge at its center and upward flutes or waves at its edges has the form of FIG. 4.

The signal from the pressure transducer 18 may be supplied to the set point element 38 of the roll control system for an inflatable back up roll 31 in mill stand housing 51 in the manner shown in FIG. 2, or to other shape control apparatus as is shown in my U.S. Pat. Nos. 4,054,543 and 4,118,963 previously mentioned.

When the roll of my invention is used only for measurement of strip shape, the hydraulic fluid supply 46 is required only to compensate for leakage in the apparatus affixed to roll 50, so as to maintain a constant reference pressure level in the system. If tube 56 and pressure transducer 18 are made leak proof, rotary inlet 17 and hydraulic fluid supply 46 can be dispensed with.

While I have shown and described a presently preferred embodiment of my invention, I wish it to be understood that the invention is not limited thereto, but may be otherwise variously embodied within the scope of the following claims.

I claim:

1. A rolling mill system for flat rolled products comprising a cylindrical roll body formed with at least one constant cross-section closed internal channel spaced uniformly from its working surface extending spirally as a fraction of a turn only around a portion of the cylindrical body surface from end to end thereof and adapted to contain hydraulic fluid under pressure and fluid pressure measuring means connected with that channel, thereby continuously measuring the pressure on the roll of that portion only of the moving flat rolled product immediately opposite that portion only of the channel at the work contact line of the rotating roll.

2. The combination of claim 1 including rotary inlet means at an end of the roll and means for supplying hydraulic fluid under pressure to that inlet.

3. The combination of 1 including a closed end tube containing the hydraulic fluid positioned in the channel and connected to the pressure measuring means.

4. The combination of claim 2 including proximity trigger means positioned at an end of the roll adapted to signal the start and the end of the circumferential travel of the channel past the work contact line of the roll when the roll is rotated.

5. The combination of claim 4 in which the pressure measuring means are connected to a proximity trigger means so as to be enabled by the start signal from the proximity trigger means and disabled by the end signal.

6. The combination of claim 4 including means for closing off those means for supplying hydraulic fluid connected to the proximity trigger means so as to be enabled by the start signal from the proximity trigger means and disabled by the end signal therefrom, whereby the hydraulic fluid in the channel is trapped therein between those signals.

7. The roll of claim 1 in which the cylindrical body is an arbor surrounded by a sleeve fitting tightly thereon at its ends, a cavity between arbor and sleeve extending lengthwise thereof intermediate the sleeve ends adapted to contain hydraulic fluid under pressure, and in which the channel projects outwardly from the cavity into the sleeve, the roll being suitable for use as a back-up roll in a four-high mill.

8. The combination of claims 1, 2, 4, 5 or 6 in which the roll is the roll of claim 8.

9. The combination of claims 1, 2, 3, 4, 5 or 6 including a strip mill stand and a tension reel at the delivery side thereof, the roll being positioned in the pass line of the stand intermediate the stand and the tension reel so as to apply tension to the strip.

* * * * *